US007147427B1

(12) United States Patent
Campbell

(10) Patent No.: US 7,147,427 B1
(45) Date of Patent: Dec. 12, 2006

(54) UTILIZATION OF SPILLOVER STEAM FROM A HIGH PRESSURE STEAM TURBINE AS SEALING STEAM

(75) Inventor: Michael S. Campbell, Bay City, TX (US)

(73) Assignee: STP Nuclear Operating Company, Wadsworth, TX (US)

( * ) Notice: Subject to any disclaimer, the term of this patent is extended or adjusted under 35 U.S.C. 154(b) by 0 days.

(21) Appl. No.: 10/991,442

(22) Filed: Nov. 18, 2004

(51) Int. Cl.
*F01D 11/04* (2006.01)
*F01D 1/00* (2006.01)

(52) U.S. Cl. ..... 415/1; 415/112; 415/176; 415/169.2; 60/653; 60/657

(58) Field of Classification Search ..... 415/112, 415/175, 176, 169.2; 60/647, 653, 659, 657
See application file for complete search history.

(56) References Cited

U.S. PATENT DOCUMENTS 3,062,553 A 11/1962 Juzi
3,537,265 A 11/1970 Brown
3,935,710 A 2/1976 Dickinson
4,060,990 A 12/1977 Guido et al.
4,517,804 A 5/1985 Ura et al.
4,541,247 A 9/1985 Martin
4,561,254 A 12/1985 Martens et al.
4,584,837 A 4/1986 Sakka et al.
4,589,256 A 5/1986 Akiba et al.
4,793,141 A 12/1988 Yanai et al.
4,873,829 A 10/1989 Williamson
5,388,411 A 2/1995 McKeever et al.
5,857,338 A * 1/1999 Rigal ..... 60/657
2003/0024248 A1 2/2003 Klatt et al.

* cited by examiner

*Primary Examiner*—Edward K. Look
*Assistant Examiner*—Dwayne J White
(74) *Attorney, Agent, or Firm*—Bracewell & Giuliani, LLP

(57) ABSTRACT

A steam-driven turbine system for a power plant in which a high pressure and a low pressure turbine are coupled to a common shaft to drive an external generator. Process steam supply is used as gland sealing steam for the low pressure turbine and turbine driven steam pumps. The high pressure turbine has glands that are self sealing at higher generator outputs, and thus the turbine utilizes the process steam supply for gland sealing only during startup or at low generator outputs. The excess or "spillover" steam that is produced by the high pressure turbine at higher generator outputs is diverted away from the main condenser and/or low pressure feed heater. The spillover steam, which is normally waterlogged, is first passed through a separator to remove excess moisture. The spillover steam is next passed through a superheater to raise its temperature. The spillover steam is then directed to the low pressure turbine and/or turbine driven steam pumps so that it may be used as gland sealing steam. The process steam supply that is replaced by the superheated spillover steam can instead be used to drive the high pressure turbine and increase generator output.

21 Claims, 4 Drawing Sheets

UTILIZATION OF SPILLOVER STEAM FROM A HIGH PRESSURE STEAM TURBINE AS SEALING STEAM

BACKGROUND OF THE INVENTION

1. Field of the Invention

This invention relates to steam turbines and, more particularly, to a method and apparatus for utilizing spillover steam from the high pressure steam turbine gland casings as a source of sealing steam for a low pressure turbines and other steam turbines employed in the steam power plant.

2. Description of the Related Art

It has been common to utilize a combination of high and low pressure steam turbines in nuclear plants or other steam powered industrial facilities to produce electricity. Typically, these turbines were used to extract enthalpy and kinetic energy from heated process steam produced by some source, such as a nuclear reactor or nuclear/fossil fuel heated boiler. The enthalpy and kinetic energy in the process steam was converted into kinetic energy, which was used to drive a shaft partially enclosed within the turbine casings and coupled to an electrical generator. At the points where the shaft penetrated the turbine casings, process steam would occasionally leak out from within the turbine casings and into the atmosphere, or air from the atmosphere would sometimes leak into the turbine casings. The steam leakage out of the casings would result in diminished turbine output and water contamination of the lubricating oil system causing degraded lubrication capability and corrosion to the lube oil system and the components it serves. The air leakage into the casings would reduce the vacuum within the main condensers and hamper steam plant efficiency.

One technique that has been utilized to prevent such leakage is to supply sealing steam to the turbine glands. The sealing steam was used, along with other components, to create a leak-proof barrier between atmospheric air and the process steam in the turbine chest. High pressure steam turbines required this sealing steam only during turbine startup or at lower generator outputs. Under normal operating conditions of high generator output, the high pressure turbines and one directional low pressure turbines are generally "self-sealing." Specifically, exhaust steam was emitted from the turbine casing into the gland casing with sufficient pressure to serve as a source of sealing steam in the turbine glands. As a result, the high pressure turbine did not require sealing steam from an external source. In contrast, two direction low pressure steam turbines required a external source of sealing steam at all times during operation, regardless of the level of generator output.

It has often proven difficult to provide a convenient, efficient and cost-effective source for low pressure turbine gland sealing steam. Various techniques have been proposed in the prior art for providing this necessary sealing steam. For example, U.S. Pat. No. 3,935,710 to Dickenson shows a portion of the process steam being heated and used as low pressure turbine gland sealing steam. In this regard, reduction of steam pressure from line to near-atmospheric level typically provides sufficient superheating for use on two-direction low pressure turbines. In many cases, the pressure reduction alone produces sufficient superheating. So far as is known, however, the technique in Dickenson was not adapted or suitable for use in treating potential sources of sealing steam other than process steam from the steam plant, such as turbine exhaust steam. Alternatively, U.S. Pat. No. 4,541,247 to Martin shows exhaust steam being extracted from the high pressure turbine casings and then desuperheated and used as low pressure turbine gland sealing steam. Because of the desuperheated steam, the techniques of this patent are not adapted to a number of situations, such as for example with waterlogged high pressure exhaust steam, where steam requires superheating.

SUMMARY OF THE INVENTION

Briefly, the present invention provides a new and improved method of providing sealing steam for use in a steam plant. The present invention utilizes spillover steam from a high pressure steam turbine as sealing steam. The spillover steam from the high pressure turbine is first removed from the high pressure steam turbine gland casings. Moisture is next extracted from the spillover steam to dry the steam after its removal from the high pressure turbine. The dried spillover steam is then provided to a low pressure turbine for sealing purposes.

As an additional feature, the spillover steam may be superheated after moisture extraction. In addition, the spillover steam may be superheated using a portion of the process steam that drives the high pressure turbine. Also, the casing of the high pressure turbine may produce extraction steam, and the spillover steam may be superheated using a portion of this extraction steam. This superheating operation is accomplished with either a shell and tube or a pipe in pipe heat exchanger. The dried spillover steam may be provided to the steam glands of low pressure turbines and other turbines for sealing purposes.

The present invention provides a new and improved method of producing sealing steam for use in a steam plant. The spillover steam is first removed from the high pressure turbine gland casings. Moisture is next extracted from the spillover steam to dry the spillover steam after its removal from the high pressure turbine gland casings. After moisture is extracted, the spillover steam is superheated to a temperature wherein the steam can be used as sealing steam.

The present invention also provides a new and improved apparatus for producing sealing steam for use in a steam plant. The apparatus includes a high pressure turbine, a moisture separator for dewatering spillover steam from the high pressure turbine gland casing and a superheater for raising the temperature of the dewatered spillover steam to produce dry sealing steam. A low pressure turbine may receive this sealing steam from the superheater for use as gland sealing steam.

BRIEF DESCRIPTION OF THE DRAWINGS

The various aspects of the invention will now be described by way of example only with reference to the accompanying drawings, in which.

DETAILED DESCRIPTION OF THE PREFERRED EMBODIMENT

Figure 1:
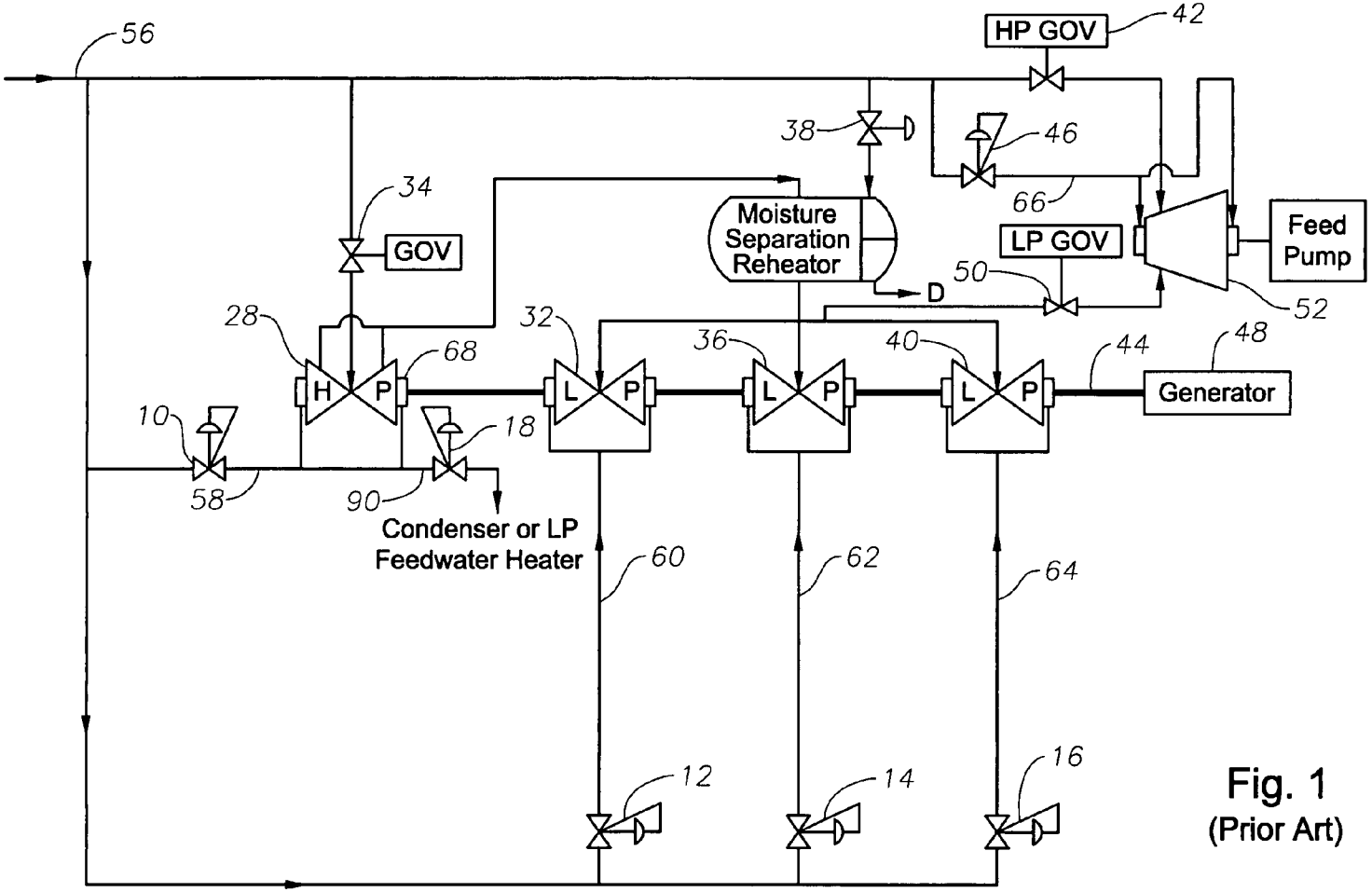
Fig. 1 (Prior Art)
FIG. 1 is a schematic diagram of a prior art gland sealing steam system.

Referring to FIG. 1, a typical gland sealing steam system for a steam driven power plant according to the prior art is illustrated. A steam driven power plant is a facility in which one or more steam turbines are utilized for industrial purposes, such as generating electrical power. Preferably, the plant utilizes a plurality of turbines, including a feedwater pump turbine 52 and a group of turbines coupled to a common shaft 44 that drive an electrical generator 48, including a high pressure turbine 28 and one or more low pressure turbines 32, 36 and 40. Gland sealing steam is supplied to the turbines 28, 32, 36, 40 and 52 by opening valves 10, 12, 14, 16 and 46, respectively, from a main process steam supply line 56.

The process steam in supply line 56 has, so far as is known, been used primarily as turbine feed steam to drive turbines 28, 32, 36, 40 and 52 and to reheat the exhaust from the high pressure turbine 28 that feeds the low pressure turbines 32, 36 and 40. After passing through valves 10, 12, 14, 16 and 46, the sealing steam from supply line 56 (now at near atmospheric pressure) enters the glands of the various turbines of FIG. 1 and, along with other components, forms a barrier to keep process steam within, and atmospheric air out of, the interiors of those turbines. The sealing steam is provided to high pressure turbine 28 by a gland steam line 58. The sealing steam is provided to the low pressure turbines 32, 36 and 40 by gland steam lines 60, 62 and 64 respectively. Sealing steam can also be provided to at least one turbine driven pump 52 from valve 46 by line 66. Turbine driven pump 52 may be used, for example, to provide feed water to a boiler for steam generation.

Figure 1A:
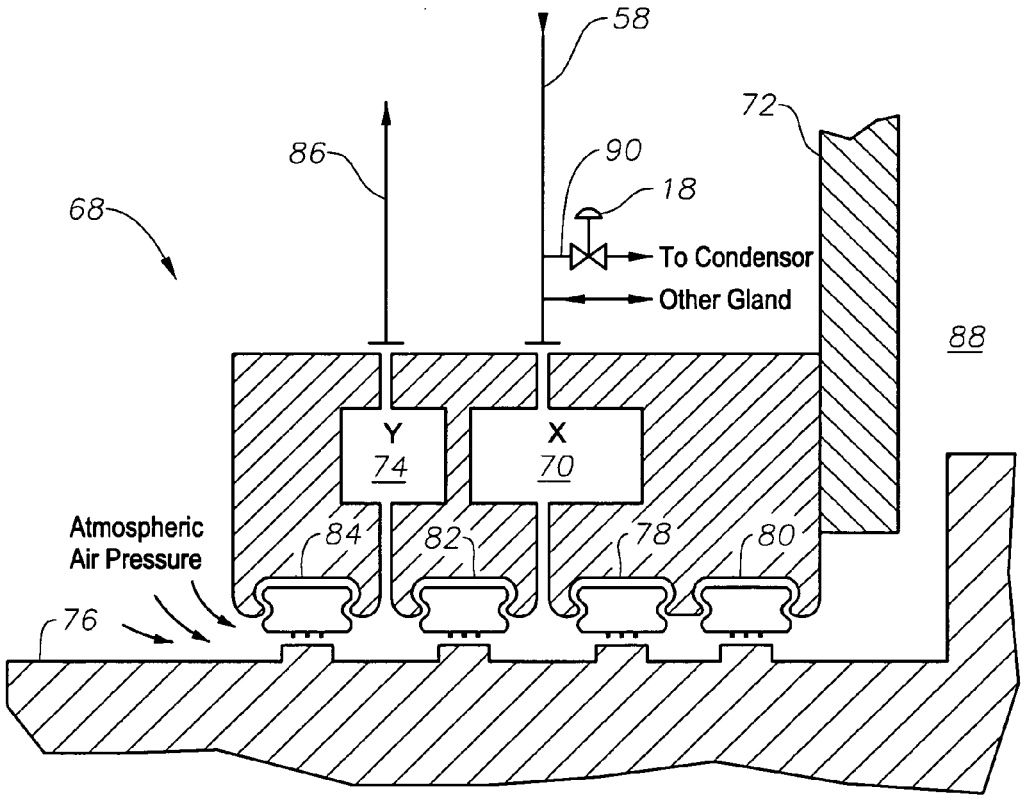
Fig. 1A (Prior Art)
FIG. 1A is a view, taken partly in cross section, of a high pressure steam turbine gland of the system of FIG. 1.

FIG. 1A is an enlarged view of a typical gland 68 of the high pressure turbine 28 in the prior art system of FIG. 1. Preferably, sealing for turbine 28 occurs within gland 68. In certain embodiments, gland 68 includes a supply chamber 70 and an exhaust chamber 74, and is attached to the housing 72 of the turbine 28. A plurality of labyrinth seals 78, 80, 82 and 84 separate the gland 68 from the turbine rotor 76. The other turbines 32, 36, 40 and 52 also contain glands with similar labyrinth seals.

Preferably, labyrinth seals 78, 80, 82 and 84 are used in gland 68 in conjunction with sealing steam to keep process steam within, and atmospheric air out of, the interior casing of the turbine 28. For example, labyrinth seal 84 between the exhaust chamber 74 and atmospheric pressure minimizes atmospheric air entry into the gland 68. Also, labyrinth seals 78 and 80 between supply chamber 70 and turbine exhaust 88 limit the amount of process steam leakage into or out of the gland 68.

During startup or at low generator output, sealing steam enters the supply chamber 70 of gland 68 through the gland steam line 58. From the supply chamber 70, the sealing steam is directed towards turbine exhaust 88 and exhaust chamber 74 of the gland 68. Sealing steam flow towards exhaust chamber 74 develops a high velocity as it flows past labyrinth seal 82 of gland 68. This high velocity allows the sealing steam flowing into the exhaust chamber 74 to pull with it any atmospheric airflow past labyrinth seal 84 that is able to overcome labyrinth seals 82 and 84 and enter gland 68.

Under standard operating conditions of high generator output from generator 48, high pressure turbine 28 is able to self seal and does not require sealing steam provided by gland steam line 58. The self sealing is a result of pressure buildup of the exhaust 88 of high pressure turbine 28. The excess pressure in the exhaust 88 forces process steam to flow past the labyrinth seals 78 and 80 into the supply chamber 70. The process steam is then forced out of chamber 70 and into steam line 90. This internally generated steam flow from the exhaust 88 is typically at a rate which is an order of magnitude higher than the external sealing steam flow that chamber 70 receives by gland steam line 58 at low power.

The process steam lost from the exhaust 88 and into gland 68 as a result of excess pressure is called "spillover" steam. If this spillover steam is not evacuated from the gland 68, the spillover steam can cause a pressure increase which could result in damage to the gland 68 and the turbine labyrinth seals 78, 80, 82 and 84 and overloading of the exhaust system of the turbine 28, with consequent steam leakage from turbine 28 into the environment and the bearing lube oil system.

Ideally, the spillover steam from turbine 28 would be diverted through gland steam line 58 for further use in potential steam recipients, such as the low pressure turbines 32, 36 and 40 and/or turbine driven pump 52. For example, the spillover steam could be used as an additional or replacement source of gland sealing steam. However, the spillover steam from turbine 28 is typically waterlogged. The water component in such spillover steam quenches the superheating capacity of the dry component of the steam. As a result, the spillover steam, in this particular form, could not be heated to an high enough temperature to be suitable for further use as a sealing steam in the glands of the low pressure turbines 32, 36 and 40 and/or turbine driven pump 52. Instead, the waterlogged spillover steam had to be diverted to another destination. A spillover steam diversion line 90 with a valve 18 branches off of the gland steam line 58. Valve 18 on spillover steam diversion line 90 is opened so that spillover steam flow from gland 68 is directed to a condenser or low pressure feedwater heater.

Figure 2:
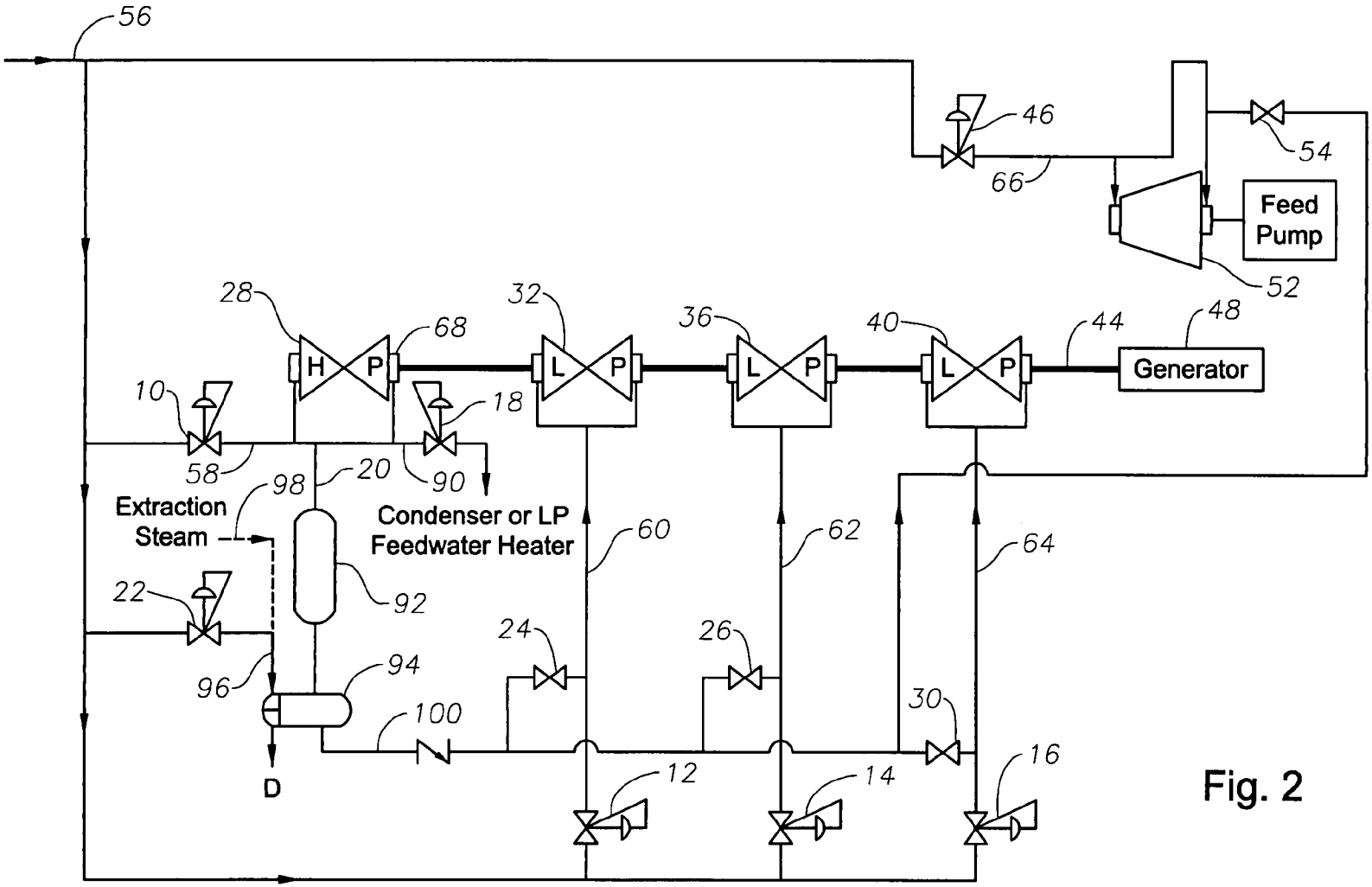
FIG. 2 is a schematic diagram of a gland sealing steam system according to the present invention.
Figure 3:
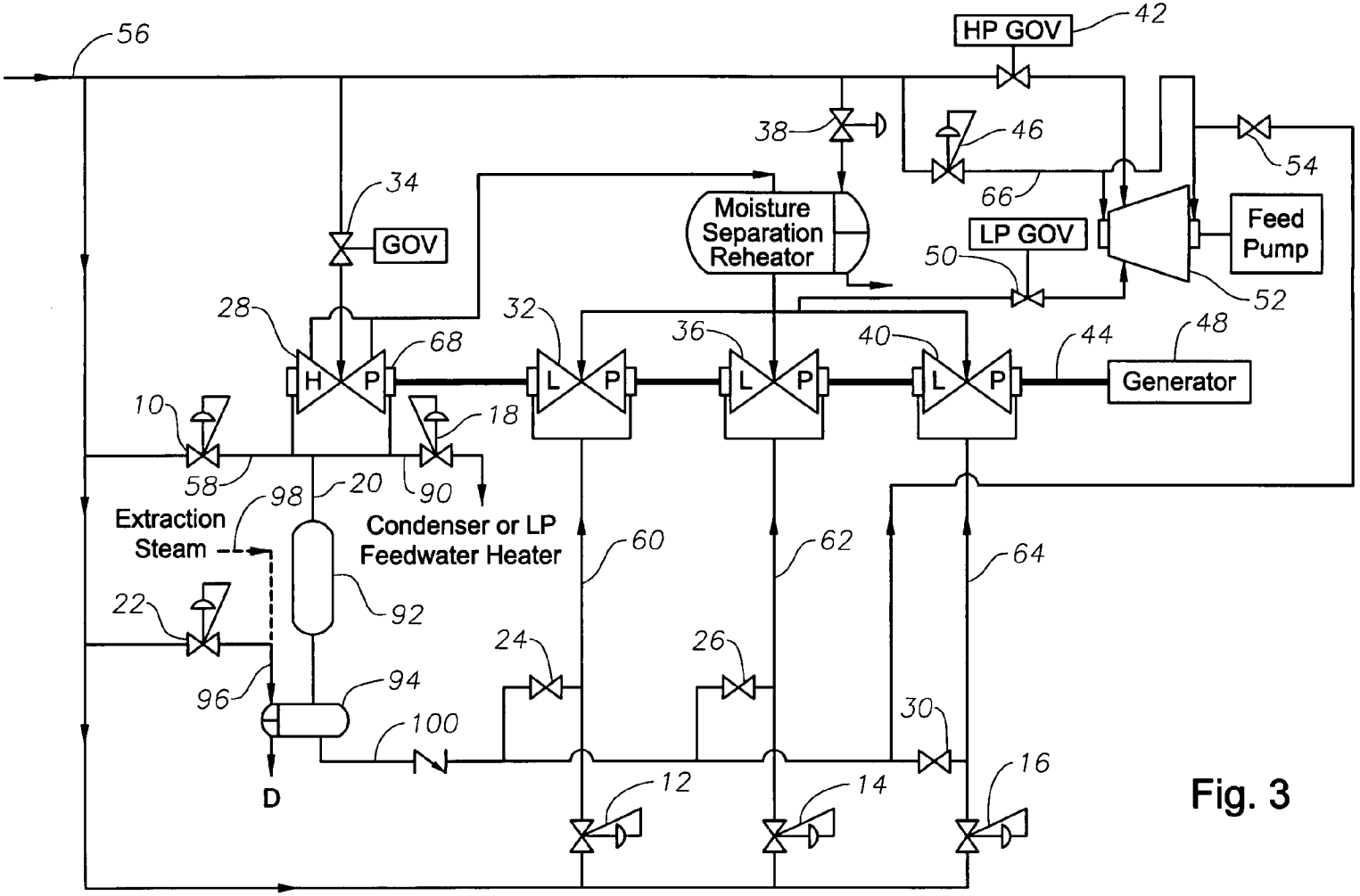
FIG. 3 is another schematic diagram of a gland sealing steam system according to the present invention.

FIGS. 2 and 3 illustrate a spillover steam utilization system provided according to the present invention. Structures in the system of FIGS. 2 and 3 which operate in a like manner to that of FIGS. 1 and 1A bear like reference numerals. In FIGS. 2 and 3, spillover steam is evacuated from the supply chamber like that shown at 70 in FIG. 1A of high pressure turbine 28 through gland steam line 90. The spillover steam is directed towards low pressure turbines 32, 36 and 40 and, if desired, turbine driven steam pump 52 for use as gland sealing steam. Valve 18 disposed on spillover steam diversion line 90 is preferably closed to prevent spillover steam from the gland from traveling to the condenser or low pressure feedwater heater.

According to the present invention, the spillover steam in steam line 20, which is typically waterlogged, is treated before it is utilized as sealing steam in the glands of low pressure turbines 32, 36 and 40 and/or turbine driven pump 52. In this regard, after leaving high pressure turbine 28, the spillover steam first passes through a moisture separator 92. In a preferred embodiment, moisture separator 92 involves a tortuous path, including a series of directional changes and drains, to allow removal of some or all of the water from the steam. However, it will be appreciated that other techniques for dewatering the spillover steam, for example, a Hayward (type TS) Separator, which facilitates removal of moisture/particulate down to 10 microns, or other similar equipment, can equally as well be utilized, as would be recognized by those skilled in the art.

After leaving separator 92, the dewatered spillover steam then passes through a superheater 94 to raise the temperature of the dewatered spillover steam. This is done to ensure that any remaining moisture in the steam is reboiled. The superheater 94 may utilize a variety of alternative heat sources to raise the spillover steam temperature. In one embodiment, superheater 94 utilizes process steam, which is delivered through process steam line 96, to heat the spillover steam to the temperature required to remove moisture. Alternatively, superheater 94 can utilize some other high temperature steam source, for example, extraction steam provided from between labyrinth seals 78 and 80 within gland 68 of FIG. 1A or another extraction point of high pressure turbine 28, to heat the spillover steam. This extraction steam is provided to the superheater 94 by steam line 98. Preferably, the spillover steam is heated to a temperature and pressure that are similar to the temperature and pressure of the main process steam supply line 56, that is, approximately 1 psig and a temperature of 270° F. It is desired that superheater 94 provide approximately 50°–150° F. of superheat to the spillover steam to ensure that the spillover steam is dry and that the labyrinth seals within the low pressure turbines 32, 36, and 40 are not eroded by steam condensation inside the gland casings caused by remaining moisture.

Preferably, superheater 94 is a double pipe or shell and tube heat exchanger. However, it should be understood that other heat exchange techniques of the types known and understood by those skilled in the art may be utilized. Superheater 94 also preferably incorporates a temperature control valve 22, or alternatively, a pressure regulator on the heating system, to control the temperature and pressure of the spillover steam exiting superheater 94.

After leaving superheater 94, the spillover steam is directed through spillover steam supply line 100 to low pressure turbines 32, 36 and 40 and, if desired, turbine driven pump 52 for use as gland sealing steam. Alternatively, the spillover steam in supply line 100 may be mixed with the process steam from the normal supply lines 60, 62, 64 and 66 to provide supplementary gland sealing steam. The process steam in supply lines 60, 62, 64 and/or 66 that is no longer used as gland sealing steam is instead used as a turbine feed stream to drive high pressure turbine 28 and produce additional electricity.

The present invention is particularly beneficial for use in a system such as shown in FIGS. 2 and 3 with a turbine train having a two-directional high pressure turbine and a two-directional low pressure turbine. A two-directional low pressure turbine typically does not have the capability to produce sufficient spillover steam from its casing to provide for self sealing. Thus, external sealing steam is highly useful, and the spillover from high pressure turbine 28, once treated according to the present invention, is ideally suited for use as sealing steam for two-directional low pressure turbines according to the present invention.

The present invention is also particularly suited for use with a two directional, high pressure turbine which utilizes a saturated steam feed, as is the case, for example, in certain nuclear and geothermal plants. The boilers that produce steam in these plants typically have operating temperatures between 450° and 750° F. These temperatures cannot provide steam that is hot enough to give appreciable superheating to a saturated steam feed for a high pressure turbine. As a result, moisture is generated at the turbine exhaust. For example, a high pressure turbine operating with an inlet pressure of 1000 psig and an exhaust pressure of 165 psig would require approximately 235° F. of superheat to prevent moisture production at the exhaust. Typically, nuclear and geothermal plants have once-through boilers that only provide 0° to 25° F. of superheat. Thus, the high pressure turbines in these and similar facilities produce a spillover steam that is too moist to be used as gland sealing steam without some form of treatment. The present invention is especially suited for treating the spillover steam product from a high pressure turbine with a saturated steam feed so that the steam may be used as low pressure turbine sealing steam.

The present invention has a number of advantages. Use of the high pressure turbine spillover steam as sealing steam, when treated according to the present invention, allows additional process steam to be diverted for use in powering the turbines and generating electricity. It is estimated that this would result in increased generator output on the order of approximately 2 MW in a steam plant otherwise producing 1300 MW of electrical power. Also, the present invention eliminates the potential problems which could result from excess exhaust steam in the high pressure turbine, for example, overpressurized gland casings or water in the lubricating oil.

While the invention has been described herein with respect to a preferred embodiment, it should be understood by those that are skilled in the art that it is not so limited. The invention is susceptible of various modifications and changes without departing from the scope of the claims. For example, while certain embodiments of the present invention shown and described herein incorporate a single process unit, it is to be understood that a plurality of process units may also be incorporated without departing from the spirit or scope of the present invention. Examples of the aforementioned process units include, but are not limited to, a high pressure turbine, a low pressure turbine, a superheater, and a moisture separator.

I claim:

1. A method of generating sealing steam from spillover steam from a high pressure steam turbine in a steam plant, comprising the steps of:

removing the spillover steam from the high pressure steam turbine;

extracting moisture from the spillover steam to dry same; and providing the dried spillover steam to a low pressure steam turbine for sealing purposes.

2. The method of claim 1, further comprising the step of superheating the spillover steam after the step of extracting moisture.

3. The method of claim 2, wherein the high pressure steam turbine is driven by a process steam stream, and wherein the spillover steam is superheated using at least some of the process steam stream.

4. The method of claim 2, wherein the high pressure steam turbine produces an extraction steam stream, and wherein the spillover steam is superheated using at least some of the extraction steam stream.

5. The method of claim 2, wherein the step of superheating the spillover steam is performed by a shell and tube heat exchanger.

6. The method of claim 2, wherein the step of superheating the spillover steam is performed by a pipe in pipe heat exchanger.

7. The method of claim 1, wherein the steam plant includes one or more turbine driven pumps, and further comprising the step of:

directing at least a portion of the spillover steam to at least one turbine driven pump after the step of extracting moisture.

8. The method of claim 1, wherein the steam plant includes one or more low pressure steam turbines, and further comprising the step of:

providing the dried spillover steam to a gland of the low pressure steam turbine for sealing purposes.

9. The method of claim 1, further comprising the step of:

providing a saturated steam feed to the high pressure steam turbine.

10. The method of claim 1, wherein the high pressure steam turbine comprises a two directional high pressure steam turbine.

11. The method of claim 1, wherein the low pressure steam turbine comprises a two directional low pressure steam turbine.

12. A method of producing sealing steam for use in a steam plant, comprising the steps of:

removing a spillover steam stream from a high pressure steam turbine;

removing at least some moisture from the spillover steam stream to dry same; and superheating the dried spillover steam stream to a temperature wherein the steam can be used as sealing steam.

13. The method of claim 12, wherein the steam plant includes one or more low pressure steam turbines, and further comprising the step of:

providing the spillover steam stream to the low pressure steam turbine for use as sealing steam after the step of superheating.

14. The method of claim 12, wherein the high pressure steam turbine comprises a two directional high pressure turbine.

15. The method of claim 12, further comprising the step of:

providing a saturated steam feed to the high pressure steam turbine.

16. The method of claim 12, wherein the high pressure steam turbine is driven by a process steam stream, and wherein the spillover steam stream is superheated using at least some of the process steam stream.

17. The method of claim 12, wherein the steam plant includes one or more low pressure steam turbines, and further comprising the step of:

providing the spillover steam stream to a gland of a low pressure turbine for sealing purposes after superheating.

18. An apparatus for providing sealing steam for use in a steam plant, comprising:

a high pressure steam turbine that produces a spillover steam stream;

a moisture separator for dewatering the spillover steam stream produced by the high pressure steam turbine; and a superheater for heating the dewatered spillover steam stream to produce sealing steam.

19. The apparatus of claim 18, wherein the high pressure steam turbine is a two directional high pressure steam turbine.

20. The apparatus of claim 18, wherein a feed stream to the high pressure steam turbine comprises saturated steam.

21. The apparatus of claim 18, further comprising a low pressure steam turbine for receiving the heated sealing steam from the superheater for use as gland sealing steam.

* * * * *